United States Patent [19]

Yoshikane et al.

[11] 3,972,154

[45] Aug. 3, 1976

[54] METHOD FOR STORING HEATED ASPHALT MIXTURE

[75] Inventors: Toru Yoshikane, Nagoya; Kunihiko Kondo, Kasugai; Kazuya Otaki, Nagoya; Hiroyasu Funabashi, Kasugai; Toru Hasegawa, Kuwana; Ichiro Yamada, Nagoya, all of Japan

[73] Assignee: Taiyu Doro Kensetsu Kabushiki Kaisha, Nagoya, Japan

[22] Filed: Mar. 26, 1975

[21] Appl. No.: 562,045

[30] Foreign Application Priority Data

Mar. 28, 1974 Japan ..... 49-34952

[52] U.S. Cl. ..... 53/25; 53/127; 222/196

[51] Int. Cl.[2] ..... B65B 55/00

[58] Field of Search ..... 53/11, 25, 127; 222/196

[56] References Cited

UNITED STATES PATENTS

| | | | |
|---|---|---|---|
| 1,973,634 | 9/1934 | Lang | 53/11 X |
| 3,304,065 | 2/1967 | Eaton | 222/196 X |
| 3,765,142 | 10/1973 | Lindquist et al. | 53/11 |

*Primary Examiner*—Travis S. McGehee
*Attorney, Agent, or Firm*—Dennison, Dennison, Meserole & Pollack

[57] ABSTRACT

A method for storing heated asphalt mixture is disclosed, in which superheated steam and an asphalt mixture, both of which are heated to about 150°C, are injected into a container to displace air thereby, and then the container is sealingly closed. Thus, the heated asphalt mixture will not lose its desired characteristics and hence may be stored for a considerably long period of time.

3 Claims, 4 Drawing Figures

Fig. 2 Storing pressure : 0.1–0.01 Kg/cm²
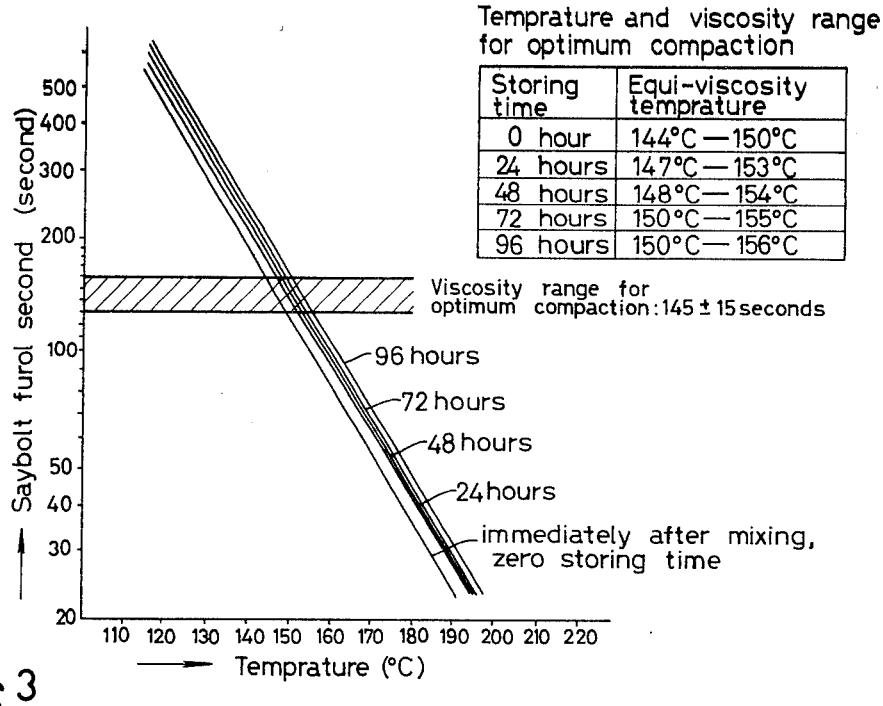
Fig 3
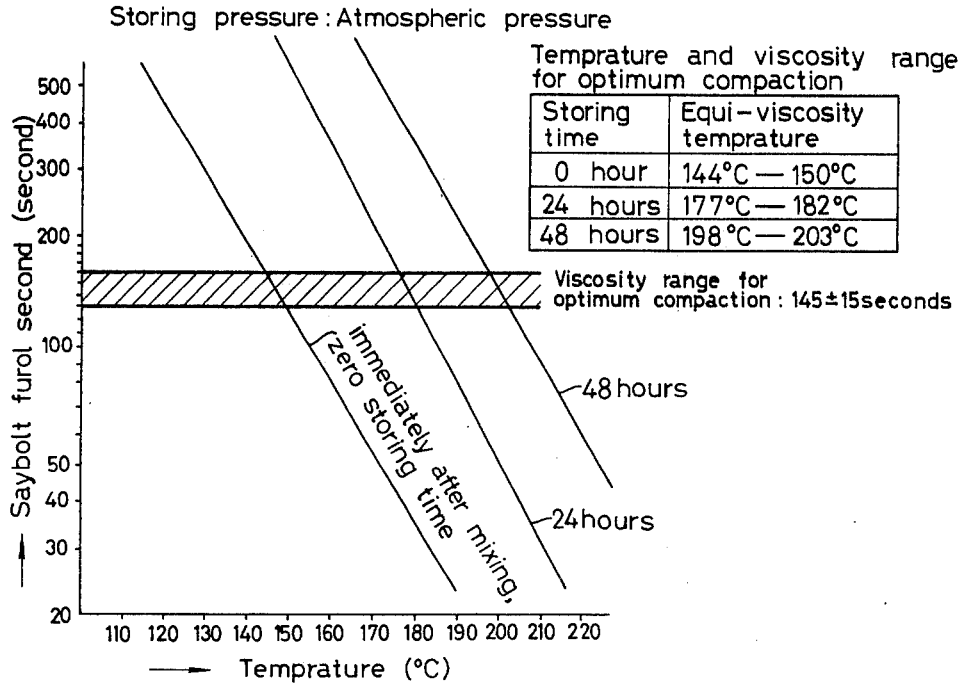

METHOD FOR STORING HEATED ASPHALT MIXTURE

BACKGROUND OF THE INVENTION

1. Field of the Invention

This invention relates to a method for storing a heated asphalt mixture, and more particularly to a method for storing a heated mixture of asphalt such as straight asphalt, semiblown asphalt, blown asphalt, natural asphalt and their mixtures.

2. Description of the Prior Art

Hitherto, it has been a common practice to store heated asphalt mixture in a container under atmospheric pressure. However, such a method suffers from deterioration of the asphalt, because of its contact with oxygen contained in the atmosphere and the decrease in temperature of the asphalt. (Meant by the term, "asphalt" as used herein are straight asphalt, semiblown asphalt, blown asphalt, natural asphalt and their mixtures.) More particularly, it was proved that the penetration degree of asphalt recovered from the mixture after it has been stored for 12 hours was lowered to as low as about 50%, as compared with that of the asphalt recovered immediately after mixing, and that the viscosity of the former was increased to a considerable degree, thereby presenting a deteriorated asphalt mixture which could no longer be used. For this reason, it has been customary that the asphalt is stored only for periods of about several hours. In this case, however, attempts have been proposed to provide a heating device for an asphalt-storing container to prevent the decrease in temperature of a heated asphalt mixture. However, this attempt only meets with partial success, still suffering from the deterioration such as lowering in penetration degree and extreme increase in viscosity of asphalt due to its contact with oxygen contained in the atmosphere. In other words, the storage of asphalt results in the deterioration such as extreme decrease in penetration degree of asphalt contained in the mixture, and thus the asphalt will no longer be useful after a short period of time, as has been described so that an attempt to heat an asphalt mixture in storage presents no real improvement in this aspect of the aforesaid shortcomings. As a result, only a heat retaining or insulating device is used for the aforesaid purpose.

Due to the shortcomings experienced with a heated asphalt mixture, if the construction is interrupted due to rail fall or troubles such as in a paving machine and the like, or in case an excessive asphalt mixture results for some reason or other during the construction, or otherwise in case such an excessive asphalt mixture has to be stored for over 12 hours, say for a relatively long period of time including an off-day, then the stored asphalt mixture has to be discarded. There has been another unfavorable aspect of the stored asphalt mixture in that, due to the strict regulation for the night-time operation of a heated asphalt-mixture mixing machine, the heated asphalt mixture which has been mixed during day time has to be thrown away and hence can not be stored over a night, due to the aforesaid deterioration, thus hindering the satisfactory progress of the construction to a great extent.

SUMMARY OF THE INVENTION

It is accordingly a principal object of the present invention to provide a simple but effective method for storing a heated asphalt mixture for a long period of time without impairing its desired properties.

According to the present invention, there is provided for the purposes of achieving the aforesaid object a method for storing a heated asphalt mixture, which includes the steps of injecting into a container superheated steam maintained at about 150°C under the pressure of 0.1 to 0.01 kg/cm$^2$ to displace air thereby, charging in the container a heated asphalt mixture maintained at about 150°C, and then sealingly closing the container. In this respect, the sequence of charging or injecting the superheated steam and an asphalt mixture may be reversed, and the heated asphalt mixture may be stored for a long period of time without losing its desired properties. Meanwhile, if the temperature of the heated asphalt mixture tends to be lowered, then fresh superheated steam may be supplied into the container.

These and other objects and features of the present invention will be apparent from a reading of the ensuing part of the specification in conjunction with the accompanying drawings which indicate a preferred embodiment of the invention.

BRIEF DESCRIPTION OF THE DRAWINGS

FIG. 2 and FIG. 3 are plots showing the relationship between the temperatures and viscosities of the recovered asphalts at varying storing periods of time, in the cases of the method of the invention and prior art.

DESCRIPTION OF THE PREFERRED EMBODIMENTS

Figure 1:
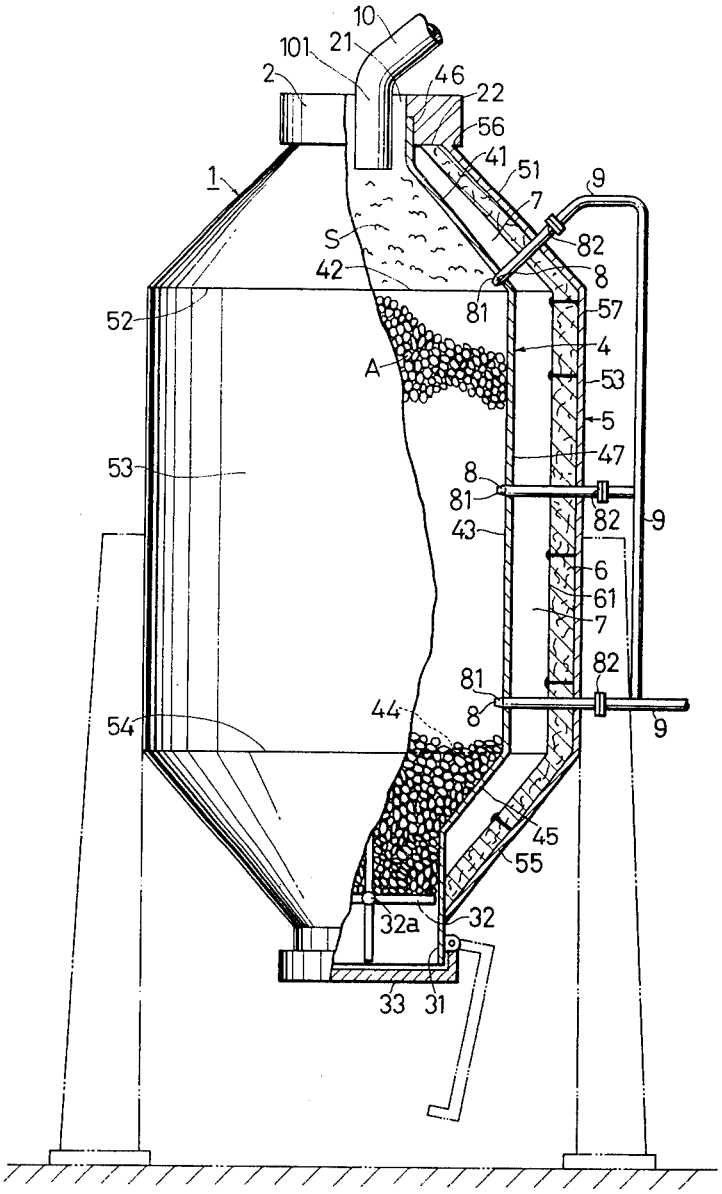
FIG. 1 is a side view, partially broken, of one embodiment of a machine practicing the method according to the present invention.

Referring now to FIG. 1, there is shown at 1 a body proper of a container containing a heated asphalt mixture therein. The container 1 is maintained in an erected relation to the ground and consists of an inner cylinder 4 and an outer cylinder 5 which is radially spaced from the wall of the inner cylinder 4. The inner cylinder 4 consists of an upper conical portion 41 which is convergent towards its top, an intermediate cylindrical portion 43 continuous with the upper conical portion 41 and a lower conical portion 45 which is convergent towards the bottom of the cylinder 4. Likewise, the outer cylinder 5 consists of an upper conical portion 51 which is convergent towards the top of the cylinder 5, an intermediate cylindrical portion 53 continuous with the upper conical portion 51 along a lower edge portion 52 which is at the same level as that of the lower edge portion 42 of the upper conical portion 41, and a lower conical portion 55 continuous with the intermediate cylindrical portion 53 along a lower edge portion 54 which is at the same level as that of the lower edge portion 44 of the intermediate cylindrical portion 43 of the inner cylinder 4, the aforesaid lower conical portion 55 being convergent towards the bottom of the container 1. The top end opening in the upper conical portion 41 of the inner cylinder 4 is sealingly continuous with a circular injecting port 21 of an injector 2, while the top end opening 56 in the upper conical portion 51 of the outer cylinder 5 is sealingly continuous with the undersurface 22 of the injector 2. Defined in the bottom end portion of the lower conical portion 45 of the inner cylinder 4 is an outlet 31 having a circular cross section, while the bottom end portion of the lower conical portion 55 of the outer cylinder 5 is sealingly connected to the wall of the exit 31 in the lower conical portion 45 of the inner cylinder 4. Placed in the exit 41 is discharging means 32 which consist of four blades and are secured to a shaft 32*a* at an angular spacing of 90°. The blades 32 are adapted to be rotated at an intermittent cycle, while a door 33 is pivotally attached to the bottom end of the exit 31, being adapted to be opened or closed by means of an operating mechanism not shown. Bonded to the entire inner circumferential surface 57 of the outer cylinder 5 is a heat insulating material 6 having a desired thickness to give a cylindrical form, with a void portion 7 being confined between the inner circumferential surface 61 of the heat insulating material 6 and the outer circumferential surface 47 of the inner cylinder 4. A plurality of injection nozzles 8 extend through the outer cylinder 5 inwardly, with their nozzle tips 81 located in a projecting manner into the interior of the inner cylinder 4. The outer ends 82 of the nozzles 8 are connected, outside the outer cylinder 5 by way of steam pipes 9 to a steam producing means (not shown). Shown at 10 is an injection or charging pipe, which is used to charge a heated asphalt mixture to be stored, and the pipe 10 is inserted into the injection port 21 of the injector 2.

In operation, superheated steam, which is maintained at a temperature of about 150°C, i.e., the storing temperature for the asphalt mixture, is injected under a pressure slightly higher than atmospheric pressure through steam pipe 9 and nozzles 8 into the interior of the inner cylinder 4 to thereby fill the same.

Subsequently, a heated asphalt mixture containing asphalt and aggregates such as crushed stone and sand plus a filler such as powder stone, which are all maintained at a temperature of about 150°C, is charged through the injection port 21 of the injector 2 attached to the body proper 1. As a result, as the charging of the asphalt mixture proceeds, part of the steam within the inner cylinder 4 is displaced thereby by passing through the gap defined between the injection port 21 and the injection pipe 10 outside the container. In this respect, since the pressure of the superheated steam within the inner cylinder 4 is higher than the atmospheric pressure, the atmosphere will not make ingress into the inner cylinder 4. After the air contained in the heated asphalt mixture has been suficiently displaced by the superheated steam, the injection port 21 is closed with a known door means, whereupon the supply of superheated steam is interrupted. Then, the particles of the heated asphalt mixture are encompassed with superheated steam. More specifically, the asphalt contained in the heated mixture covers the surfaces of the aggregates such as crushed stone and sand as well as the surfaces of the filler such as powder stone, in the form of thin films having thickness of several microns, thereby providing granules of varying sizes. In this respect, there result voids among granules thus formed, so that the superheated steam makes ingress into the aforesaid voids. It follows then that the surfaces of the asphalt contained in the heated asphalt mixture are encompassed with the superheated steam, so that the asphalt is prevented from contact with oxygen contained in air, and that the temperature within the inner cylinder 4 is maintained for a considerable long period of time by means of the heat insulating material 6 at a temperature substantially the same as the starting temperature when storing the asphalt mixture for the first time. This in turn maintains the viscosity and penetration degree of the heated asphalt mixture substantially to the same degree as that obtained when starting to store the heated asphalt mixture, thus causing no appreciable deterioration in the properties of asphalt. In addition, since the pressure of the superheated steam filled therein is higher than the atmospheric pressure, even if the door 33 is opened so as to discharge the heated asphalt mixture outside, the atmosphere will be prevented from making ingress into the interior of the inner cylinder 4, thereby maintaining the aforesaid favorable condition. However, if there is a danger that the pressure of superheated steam would be lower than the atmospheric pressure, then fresh superheated steam may be introduced through the injection nozzles 8 into the inner cylinder 4, thereby maintaining the pressure of the superheated steam within the inner cylinder 4 to a level higher than the atmospheric pressure.

The description given thus far has referred to the example wherein the heated asphalt mixture is introduced into the inner cylinder 4, with the superheated steam being filled therein beforehand. However, the present invention is by no means limited to this instance. As an alternative, a heated asphalt mixture maintained at about 150°C may be first injected or charged under the atmospheric pressure into the inner cylinder 4 and then air within the inner cylinder 4 may be displaced by superheated steam which is maintained at a temperature of about 150°C and a pressure higher than the atmospheric pressure, to thereby prevent the asphalt from its contact with air, after which the injection port 21 is closed. In this case, an air exhaust valve (not shown) may be provided for the upper conical portion 41 of the inner cylinder 4, and a door is closed after charging the mixture in the inner cylinder 4, after which superheated steam having a pressure higher than the atmospheric pressure is introduced through the injection nozzles 8 into the interior of the inner cylinder 4 to thereby discharge the air contained in the heated asphalt mixture outside the container. Then, the air exhaust valve is closed thereafter.

Still alternatively, a heating means may be provided for the container to produce a superheated steam within the inner cylinder 4 for the purpose of displacing the air by the superheated steam.

Figure 4:
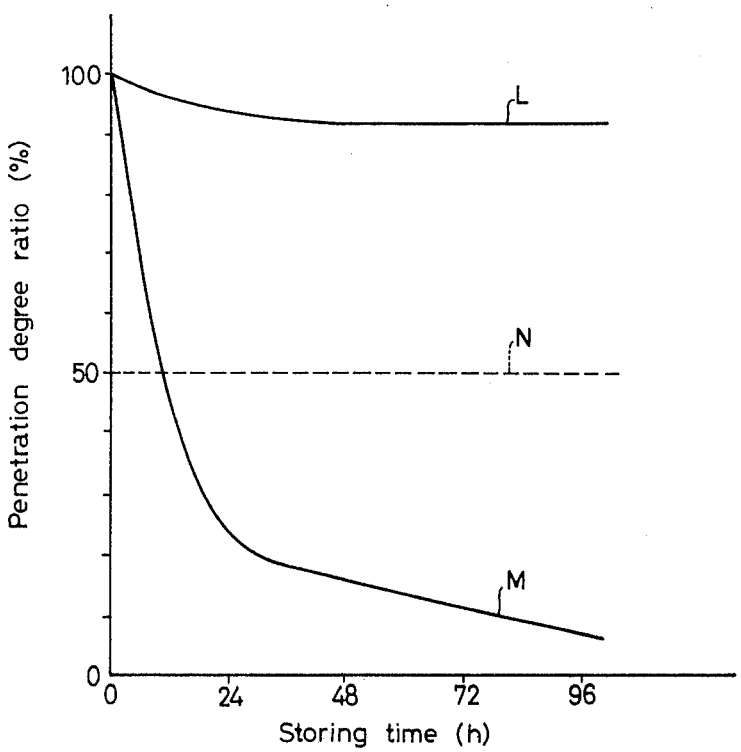
FIG. 4 is a plot illustrating the relationship between the storing period of time and the penetration degree of a recovered asphalt.

For comparison purpose, the results of the heated asphalt mixture stored according to the method of the present invention and those obtained according to the prior art will be hereunder described by referring to the tests for (i) saybolt furol viscosity, (ii) asphalt penetration degree ratio and (iii) Marshal stability, by using high grading type asphalt-concrete which conforms to the requirements for the asphalt pavement, the requirements being set forth by Japan Road Association.

i. Saybolt furol viscosity test:

FIGS. 2 and 3 show the relationship between the temperature and viscosity of asphalts which are recovered, according to the method specified under A.S.T.M.D. 1856–65, from the heated asphalt mixture stored at a temperature of 150°C at varying storing times as well as from the mixture immediately after mixing. The aforesaid relationship was obtained according to the saybolt furol viscosity test method specified under A.S.T.M.E. 102–57. As can be seen from the plots given in FIGS. 2 and 3, the temperature range for the optimum compacting viscosity covers from 150° to 156°C even after the 96 hours' lapse of time in the case of the method of the present invention, presenting no appreciable difference as compared with the temperature range of 144° to 150°C in the case of the asphalt recovered immediately after mixing. In contrast thereto, according to the prior art, the temperature range for the optimum compacting viscosity was proved to cover from 144° to 150°C in the case of the asphalt recovered immediately after mixing. Thus, after the lapse of 24 and 48 hours, the optimum compacting viscosity may not be obtained, unless the mixture is re-heated to temperatures ranging from 177° to 182 °C and from 198° to 203°C, respectively. However, it should be noted that, even if the optimum compacting viscosity is obtained by heating the mixture to the aforesaid temperature, the properties of the asphalt itself has been deteriorated and hence the asphalt mixture can no longer be used, as is best shown by the results of the tests for penetration degree ratio and Marshal stability.

ii. Asphalt penetration degree ratio test:

FIG. 4 shows the results of the actually measured values representing the relationship between the penetration degree ratio of asphalt recovered from the mixture, and the storing time, according to the present invention and the prior art. In FIG. 4, the curve (L) represents the aforesaid relationship of the asphalt recovered from a heated asphalt mixture stored, by using steam having a pressure of 0.1 to 0.01 kg/cm² according to the present invention, the curve (M) represents the aforesaid relationship of the asphalt recovered from a heated asphalt mixture stored according to the prior art, and the curve (N) represents the lower limit for an asphalt mixture which is considered to be usable. The factors involved in the above tests are as follows:

$$\text{Penetration degree ratio} = \frac{\text{penetration degree of asphalt recovered from a mixture after storage}}{\text{penetration degree of asphalt recovered from a mixture immediately after mixing}} \times 100\%$$

Storing temperature: 150°C

Recovering method of asphalt: Abson process, AST.M.D. 1856–65

Penetration degree test: JISK 2530–1961

Testing temperature . . . 25°C

Weight of sample piece . . . 100g

As is best shown in the plot given in FIG. 4, the penetration degree ratio of the asphalt is reduced to about 50% within the time period of 12 hours, and thus the asphalt mixture is no longer used, if resorting to the prior art. On the contrary, according to the method of the present invention, about 92% penetration degree ratio may be maintained even after the 96 hours' lapse of time, and hence the mixture stored may be used safely.

iii. Marshal stability test:

Table 1 which will be given hereinafter shows the results of the Marshal stability test at varying storing periods of time according to the storing methods of the present invention and the prior art. The test results reveal that according to the prior art, only 24 hours' lapse of time results in difficulties in molding the sample of the asphalt mixture and the lapse of time over the 24 hours renders the molding entirely impossible. In contrast thereto, according to the present invention, even 96 hours' lapse of time leads to little deterioration in the asphalt mixture which is then usable.

Description has been given of the aforesaid storing examples by referring to saybolt furol viscosity test, penetration degree ratio test and Marshal stability test, in which superheated steam at a temperature of 150°C under the pressure of 0.1 to 0.01 kg/cm² is used for the method according to the present invention. However, it should not be construed that the present invention is limited to the aforesaid values of the pressure and temperature for the superheated steam. It is essential for the method of the present invention that steam devoid of water in the form of liquid be used. More particularly, if water of a liquid form is present in the heated asphalt mixture, then the water is absorbed into aggregates, with the result that if the asphalt is subjected to the repeated traffic load after being formed into pavement, then the films of the asphalt are peeled from the aggregates under the influence of water, thereby bringing about the failure in the pavement. For this reason, the present invention uses superheated steam or saturated steam rather than the steam containing water of a liquid form which would lead to such a failure of the pavement.

Meanwhile, the saturated steam maintains the saturated condition, i.e., a dried condition for an asphalt mixture, under a given pressure at a given temperature, and thus the saturated steam may be used for the method according to the present invention. However, since the saturated steam tends to be changed into wet steam with the decrease in temperature, to produce water of a liquid form, there results difficulties in controlling the saturated steam. Accordingly, it would be even more advantageous for the method for the present invention to use superheated steam rather than saturated steam.

Table 1

| Type of storage | Storing time | Marshal stability test results (50 cycles, both side compacted. at 60°C) | | | | | | | | penetration degree of asphalt after recovery | moldability of sample |
|---|---|---|---|---|---|---|---|---|---|---|---|
| | | apparent density | theoretical density | void percentage | saturation degree | stability | flow | residual stability (48 h) | S/F | | |
| | | gr/cm³ | gr/cm³ | | | | | | | | |
| prior | 24 | 2.260 | 2.428 | 6.9 | 65.9 | 1514 | 39 | 90.2 | 38.8 | 17 | fairly difficult |
| art | 48 | 2.238 | " | 7.8 | 62.9 | 1312 | 25 | 88.4 | 52.5 | 12 | extremely difficult |
| (atmospheric | 72 | — | " | — | — | — | — | — | — | 8 | impossible |
| pressure) | 96 | — | " | — | — | — | — | — | — | 5 | impossible |
| present | 24 | 2.330 | " | 4.0 | 77.2 | 1150 | 31 | 91.6 | 37.0 | 69 | good |
| invention | 48 | 2.329 | " | 4.1 | 77.2 | 1065 | 29 | 92.4 | 36.7 | 70 | good |
| (0.1 to 0.01 | 72 | 2.329 | " | 4.1 | 77.2 | 1105 | 31 | 94.7 | 35.6 | 71 | good |
| kg/cm²) | 96 | 2.328 | " | 4.1 | 77.0 | 1178 | 31 | 97.9 | 38.0 | 70 | good |
| immediately | | | | | | | | | | | |

Table 1-continued

| Type of storage | Storing time | Marshal stability test results (50 cycles, both side compacted, at 60°C) | | | | | | | | | |
|---|---|---|---|---|---|---|---|---|---|---|---|
| | | apparent density | theoretical density | void percentage | saturation degree | stability | flow | residual stability (48 h) | S/F | penetration degree of asphalt after recovery | moldability of sample |
| after mixing | 0 | 2.330 | " | 4.0 | 77.3 | 996 | 34 | 89.1 | 29.3 | 76 | good |

It will be understood that the above description is merely illustrative of preferred embodiments of the invention. Additional modifications and improvements utilizing the discoveries of the present invention can be readily be anticipated by those skilled in the art from the present disclosure and such modifications and improvements may fairly be presumed to be within the scope and purview of the invention as defined by the claims that follow.

What is claimed is:

1. A method for storing a heated asphalt mixture, comprising the steps of:

injecting or charging superheated steam maintained at a temperature of about 150°C under the pressure of 0.1 to 0.01 kg/cm² and an asphalt mixture into a container, which is thermally insulated, to thereby displace air within said container by said superheated steam; and closing said container thereafter.

2. A method for storing a heated asphalt mixture as defined in claim 1, wherein superheated steam maintained at a temperature of about 150°C under the pressure of 0.1 to 0.01 kg/cm² is first injected into a container, which is thermally insulated, and then an asphalt mixture heated to about 150°C is charged therein.

3. A method for storing a heated asphalt mixture as defined in claim 1, wherein a heated asphalt mixture maintained at a temperature of about 150°C is first charged into a container, which is thermally insulated, to thereby displace the majority of air therein by said heated asphalt mixture, and then superheated steam maintained at a temperature of about 150°C under a pressure of 0.1 to 0.01 kg/cm² is injected into said container to displace the remaining air thereby.

* * * * *